US005402833A

United States Patent [19]

Clüsserath

[11] Patent Number: 5,402,833

[45] Date of Patent: Apr. 4, 1995

[54] APPARATUS FOR FILLING BOTTLES OR SIMILAR CONTAINERS

[75] Inventor: Ludwig Clüsserath, Bad Kreuznach, Germany

[73] Assignee: KHS Maschinen- und Anlagenbau Aktiengesellschaft, Bad Kreuznach, Germany

[21] Appl. No.: 123,005

[22] Filed: Sep. 17, 1993

[30] Foreign Application Priority Data

Sep. 17, 1992 [DE] Germany ..... 42 31 114.4

[51] Int. Cl.[6] ..... B65B 31/00

[52] U.S. Cl. ..... 141/39; 141/48; 141/49; 141/293

[58] Field of Search ..... 141/5, 6, 39, 40, 44, 141/47, 48, 49, 50, 198, 293, 302, 305, 307

[56] References Cited

U.S. PATENT DOCUMENTS 3,604,480 9/1971 Reichert ..... 141/39
3,799,219 3/1974 Uth et al. ..... 141/39
4,390,048 6/1983 Zelder ..... 141/39
4,976,295 12/1990 Clüsserath ..... 141/39
5,016,684 5/1991 Clüsserath ..... 141/39
5,082,033 1/1992 Weiss ..... 141/39
5,163,487 11/1992 Clüsserath ..... 141/39

*Primary Examiner*—Henry J. Recla
*Assistant Examiner*—Steven O. Douglas
*Attorney, Agent, or Firm*—Robert W. Becker & Associates

[57] ABSTRACT

An apparatus for filling bottles or similar containers and comprising at least one filling element having a liquid flow valve. A first and a second gas path are provided that serve for supplying and withdrawing a pressurized gas, and that during filling of a respective container communicate with the interior of this container via a third gas path. The first gas path can be controlled by a control valve, while the second gas path is in constant communication with the third gas path that leads to the interior of the container. This third gas path is common to both the first and the second gas path, and the control valve can be actuated independently from the liquid flow valve.

12 Claims, 2 Drawing Sheets

APPARATUS FOR FILLING BOTTLES OR SIMILAR CONTAINERS

BACKGROUND OF THE INVENTION

The present invention relates to an apparatus for filling bottles or similar containers with a liquid filling material from a tank.

With one apparatus of this general type, U.S. Pat. No. 3,799,219, Gerhard Uth et al, which utilizes a filling element that has no filling tube, a first gas path communicates on the one hand with a gas chamber that is formed over the level of the filling material in the interior of an annular tank of the filling machine that is not completely filled with the liquid filling material, and on the other hand, controlled via a control valve, communicates with a first gas channel that leads into the interior of the bottle that is to be filled. This first gas channel is formed in a gas tube or tube-like shaft that carries the valve body of a liquid flow valve. Pressurization of the container that is to be filled is effected via the gas path and the gas channel.

This known apparatus also has a second gas path that leads to a return gas or residual gas chamber that is provided in common for all of the filling elements of the filling machine; this gas chamber communicates with the atmosphere via an orifice or flow control means. Furthermore, this second gas path is in constant communication with a second gas chamber that is also formed in the tube-like shaft of the valve body and is open at the lower end of this shaft, which projects beyond the valve body. The second gas channel surrounds a probe that is provided in the shaft for determining the filling height.

Although with this known apparatus for controlling the gas paths only a single control valve is provided, this apparatus nonetheless has certain drawbacks. For example the known apparatus, in addition to the necessity of having to have two separate gas channels in the shaft of the valve body, moreover also has a relatively complicated and expensive construction. A further drawback of the known apparatus is that a common actuating mechanism is provided for the control valve and for the liquid flow valve, thereby greatly limiting the possibility for diversified controls or control processes. In addition, the functional elements of the control valve, and in particular also the valve body of this control valve, are not very accessible.

It is therefore an object of the present invention to improve an apparatus of the aforementioned general type such that while maintaining the fundamental advantages of the heretofore known apparatus, the drawbacks thereof are avoided, while at the same time providing a simplified construction yet improved control possibilities.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
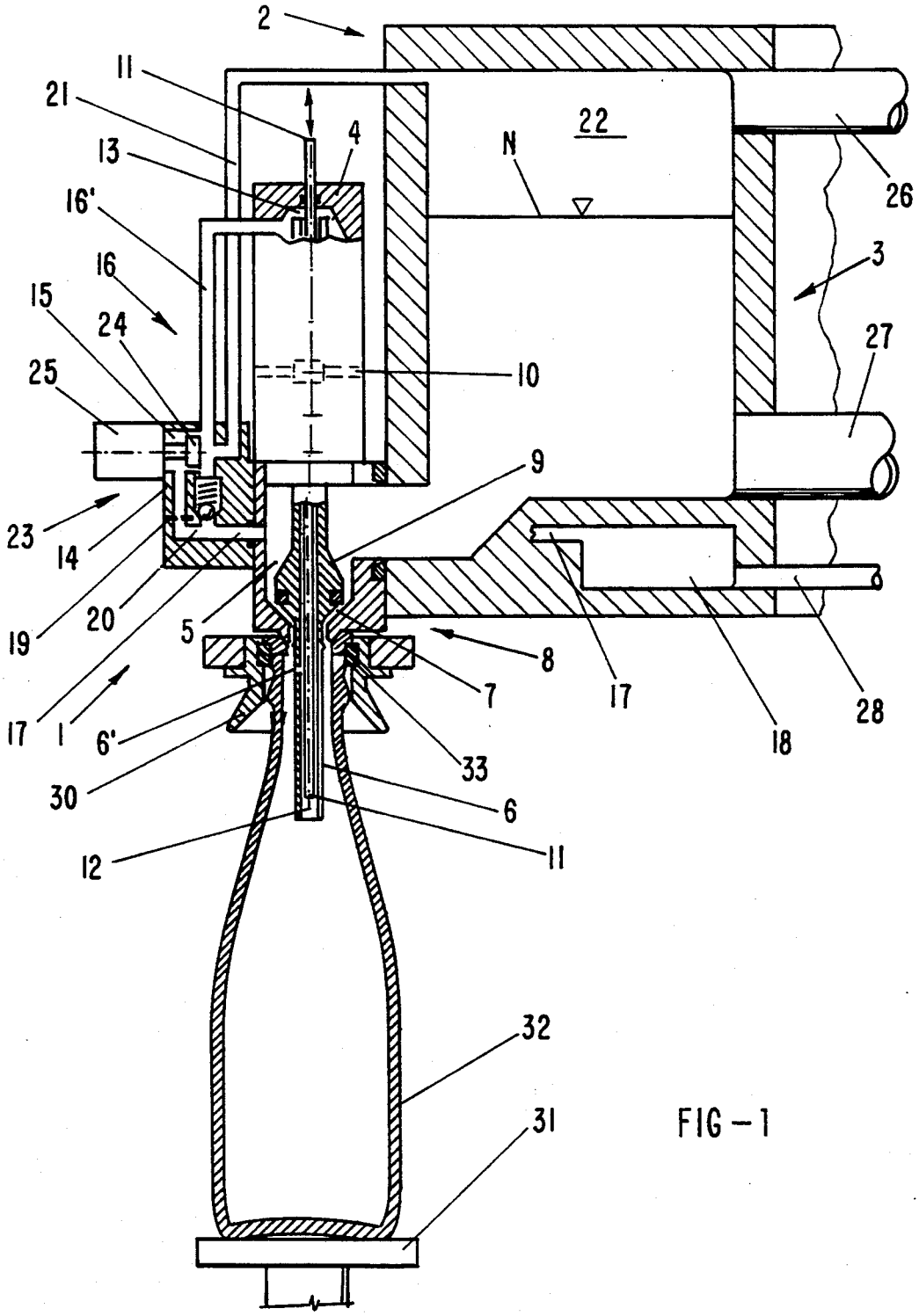
FIG. 1 is a simplified cross-sectional view of one exemplary embodiment of a filling element, provided on the periphery of the rotor that rotates about a vertical axis of rotation, of a rotating-type counter pressure filling machine, together with a bottle that is to be filled.

The apparatus of the present invention is characterized primarily by: at least one filling element, each of which has a liquid flow valve; gas paths formed at least partially in the filling element and respectively connected to the interior of a container during a filling process, the gas paths including a first gas path that communicates with a chamber of the filling material tank that contains pressurized gas at a first pressure, a second gas path for withdrawing the pressurized gas to a region having a second pressure that is less than the first pressure, and a third gas path that forms a common communication for the first and second gas paths to the interior of the container, the third gas path serving for supplying and also withdrawing the pressurized gas into and out of the container respectively; a control valve that is capable of an open position and a closed position, the control valve controlling communication of the first gas path with the third gas path and hence with the interior of the container, while the second gas path is in constant communication with the third gas path and hence with the interior of the container; a first actuating mechanism for the control valve; and a second actuating mechanism for the liquid flow valve.

With the inventive apparatus, for controlling the gas paths again in the simplest case only a single control valve is needed, with this control valve having merely two states, namely a closed state and an open state. With this control valve, the gas paths, i.e. the supplying and withdrawing of the pressurized gas into and out of the container respectively, are completely controllable, at least for the pressurization, for the counter pressure filling (preferably including slow filling, rapid filling, and/or retarded and corrective filling), as well as for the pressure relief (preferably including calming phase and/or pre-venting phase).

Since the actuating mechanism of the control valve is separate from the actuating mechanism of the liquid flow valve, and hence the control valve can be actuated independently of the liquid flow valve, the present invention avoids limitations with respect to control possibilities.

Furthermore, a simplified construction results from the inventive use of a third, common gas path for the communication of the first and second gas paths with the respective container, in other words not only for supplying but also for withdrawing the pressurized gas into and out of the container respectively.

Furthermore, the inventive apparatus can be embodied such that the control valve, and all of its functional elements, are accessible from the outside without difficulty, and can also be easily replaced in the event that repairs are necessary.

Further specific features of the present invention will be described in detail subsequently.

DESCRIPTION OF PREFERRED EMBODIMENTS

Referring now to the drawings in detail, shown is a filling element 1 that, together with further identical filling elements, is disposed on the periphery of a rotor element 3 that rotates about a vertical machine axis and forms an annular tank 2.

The filling element 1 essentially comprises a housing 4 that is secured to the rotor 3; a liquid flow channel 5 is formed in the housing 4. The upper portion of the liquid flow channel 5 communicates with the annular tank 2, while the lower portion of the liquid flow channel 5 forms an annular discharge or dispensing opening 7 for the liquid filling material; the dispensing opening 7 surrounds a gas tube 6.

Also provided in the liquid flow channel 5 is the liquid flow valve 8, which in a customary manner has a valve body 9 that cooperates with a valve seat that is formed in the interior of the liquid flow channel 5. In the illustrated embodiment, the valve body 9 is provided on the gas tube 6, the axis of which extends in a vertical direction parallel to the machine axis; the gas tube 6 projects beyond the underside of the filling element 1 as well as of the housing 4. In FIG. 1, the liquid flow valve 8 is illustrated in the opened position. To release the liquid flow valve, a pneumatic actuating or control mechanism is actuated. This control mechanism, which acts upon that portion of the gas tube 6 that extends above the valve body 9, comprises as an actuating or control element, for example, a piston, although preferably comprises a diaphragm which in FIG. 1 is schematically illustrated at 10 by dashed lines.

A probe 11 that determines the filling height is provided in the gas tube 6. This probe 11 is surrounded by the gas tube 6 but is spaced therefrom, so that there results in the gas tube 6 a gas channel 12 that is provided in an annular manner about the probe 11 and is open at the bottom end of the gas tube 6. At the upper end of the gas tube 6, the gas channel 12 opens into a chamber 13 that is formed in the housing 4 and is closed off to the outside.

On the radially outer side of the housing 4, as viewed relative to the machine axis, there is provided a valve housing 14 that forms a chamber 15 that is closed off to the outside. The chamber 15 is in constant communication with the chamber 13 via a line or channel 16'. The channel 16' and the gas channel 12 together form a gas path 16. A further gas path 17, which extends partially in the valve housing 14, partially in the housing 4, and partially in the rotor element 3, constantly connects the chamber 15 with a residual or return gas channel 18 that is common to all of the filling elements 1. A flow control means or orifice 19 is provided in that portion of the gas path 17 that is formed in the valve housing 14. Parallel to the orifice 19, the gas path 17 forms a bypass in which is disposed a check valve 20. This check valve 20, which in the illustrated embodiment comprises a ball that forms the valve body and a string, is embodied in such a way that it opens in a direction of flow from the Gas path 17 into the chamber 15 and prevents flow in the opposite direction. The chamber 15 also communicates with a gas chamber 22 via a third gas path 21 that is formed by a line or channel. The annular tank 2 is not completely filled, but rather is filled with the liquid filling material only to a prescribed level N. The gas chamber 22 is provided above this liquid level. The communication between the gas path 21 and the chamber 15 is controlled by a control valve 23 which in the non-actuated state illustrated in FIG. 1 closes the gas path 21 where it opens into the chamber 15 with its valve body 24. The control valve 23 can be actuated pneumatically, and for this purpose has a pneumatic actuating mechanism 25.

FIG. 1 also illustrates various other conduits or lines, such as the line 26 that leads into the gas chamber 22 and via which compressed gas is supplied to the gas chamber in a controlled manner, and in particular in such a way that a prescribed pressure is maintained in the gas chamber 22.

By means of the line 27, the liquid filling material is supplied to the annular tank 2, and in particular in a controlled manner in such a way that a desired level N of the filling material is maintained within a prescribed range. The line 28, which opens into the residual or return gas channel 18, leads in the illustrated embodiment to the atmosphere via a pressure regulating mechanism, so that there is maintained in this channel a prescribed pressure that is, for example, between 0.5 to 1 bar.

Also illustrated are a conventional centering tulip 30 as well as a bottle support means 31 that can be raised and lowered; a bottle 32 is shown resting on the bottle support means. To fill the bottle 32, this bottle is pressed in a conventional manner against the filling element 1, with the mouth of the bottle, via a sealing means 33, resting in a sealed manner against the filling element 1. Disposed somewhat above its lower end, the gas tube 6 is provided with an opening 6' for the gas channel 12; the cross-sectional area of this opening 6' is smaller than the cross-sectional area of the gas channel 12.

The special feature of the filling element 1 that has been described is that in order to control the gas paths merely a single, very straightforward valve, namely the control valve 23, is sufficient, with this valve having merely two operating states, namely an open state and a closed state. In the illustrated embodiment, to fill the bottle it is merely necessary to actuate the control valve 23 and the liquid flow valve 8.

With the filling element, for example during the filling of bottles 32, the following operating sequence is possible, whereby in the following description the liquid flow valve 8 as well as the control valve 23 are respectively in the closed position unless the opened position of these valves is explicitly designated.

1. Pressurization

After pressing and sealing the mouth of the bottle 32 that is to be filled against the filling element 1, the control valve 23 is opened via the actuating mechanism 25, so that via the gas path 21, which is now in communication with the chamber 15, compressed gas which in the illustrated embodiment is sterile air, passes into the chamber 15 and via the gas path 16 and the gas channel 12 into the interior of the bottle 32. Thus, via the gas tube 16 that projects through the mouth of the bottle into the interior of the bottle, the bottle 32 is pressurized to a pressure that corresponds to the pressure in the gas chamber 22. In so doing, a small amount of pressurized gas also passes into the residual gas channel 18 via the gas path 17. However, by appropriate selection of the orifice 19, care is taken that this quantity of pressurized gas is small.

2. Slow Filling

After the conclusion of a prescribed pressurization time, the control valve 23 is again closed and the liquid flow valve 8 is opened, so that the liquid filling material flows to the interior of the bottle 32 via the discharge or dispensing opening 7. The compressed or return gas that is thereby displaced from the interior of the bottle 32 flows via the gas Channel 12 and the gas paths 16 and 17 into the return gas chamber 18. The orifice 19 provides an appropriate control of the flow of the displaced stream of gas and thus provides a gentle and slow filling speed. The filling speed that is actually achieved results from the cross-sectional area of the orifice 19 and the difference between the pressure in the gas chamber 22 and in the residual gas channel 18. These two parameters can be altered or regulated as a function of the sensitivity of the filling material (e.g. beverage) that is to be dispensed. The duration of this slow filling is generally only a few hundred milliseconds.

3. Rapid Filling

In order to achieve a high specific valve capacity and efficiency, after the slow filling the non-critical central portion of the bottle 32 is filled at a high rate of inflow. For this purpose, the control valve 23 is opened so that via the gas path 21 there then exists an additional connection to the gas chamber 22 via which an additional, unrestricted flow of gas that is displaced during the filling process can be withdrawn. The filling speed during this rapid filling phase is essentially determined by the height of the level N in the annular tank 2. By regulating this level, the height of the level N, i.e. this parameter, can be adapted to the respective special requirements (such as filling characteristics of the filling material and/or the shape of the bottle 32 that is to be filled, etc.).

4. Retarded and Corrective Filling

After a prescribed period of time has passed for the rapid filling phase, the control valve 23 is again closed by the actuating mechanism 25, thereby interrupting the connection via the gas path 21 to the gas chamber 22. The filling speed is thereby reduced back to the value that existed during the slow filling phase. The level of the filling material now rises in the narrowing neck of the bottle 32 at a slower speed. No bubbles, which were suspended during the rapid filling phase due to flow turbulence, rise to the surface. The filling material level reaches the probe 11 that is disposed in the gas tube 6 with a uniform surface appearance and without bubbles. A precise determination of the filling height is possible since the filling material level has been quieted during the slowing or retarding phase.

After the probe 11 has been covered or charged, the liquid flow valve 8 is closed, and in particularly preferably with a time delay, for example a preselected time delay, that is generated for a corrective filling by control electronics, whereby a filling height correction in the range of about 10–20 mm is then possible.

During this retarded and corrective filling phase, the control valve 23 is opened briefly one or more times in a controlled manner so that the filling pressure in the bottle 32, which corresponds to the pressure in the gas chamber 22, is maintained.

5. Filling and Calming

After the liquid flow valve 8 has been closed, the pressure in the neck of the filling bottle 2 begins to be reduced, via the orifice 19 provided in the gas path 17, to the pressure that is set in the residual gas channel 18.

Also during this calming phase it is possible to briefly open the control valve 23 one or more times in a controlled manner so that for a particular calming time a pressure is maintained in the interior of the bottle that approaches the pressure in the gas chamber 22.

6. Intermediate or Pre-venting

By opening and closing the control valve 23 one or more times, this venting process, i.e., the pre-venting pressure, can be adapted to the characteristics of the respective filling material. The appropriate venting cycles, i.e., the opening times, can be preselected in a variable manner as a time function via the control electronics independently of the filler speed.

After the control valve 23 has been finally closed, the pressure in the interior of the bottle 32 is reduced via the orifice 19 to the pressure that exists in the residual gas channel 18, with this pressure being, for example, between 0.5 and 1.0 bar.

7. Final Venting and Withdrawal of the Bottle

Until the bottle 32 is actually withdrawn, the pressure that is regulated in the residual gas channel 18 is maintained in the interior of the bottle. With a slight overpressure in the interior of the bottle, the bottle 32 is then finally withdrawn, in which connection no losses due to spray occur. Since the gas tube 6 has an opening 6' via which the gas channel 12 communicates with the bottle 32 in the region of the mouth of the bottle, no expansion surge out of the gas tube 6 that would disturb the liquid filling material occurs when the bottle is withdrawn. A withdrawal at a slight overpressure can be avoided by providing an additional venting valve.

As the bottle 32 is Withdrawn, a greatly reduced stream of gas flows into the mouth of the bottle 32 from the residual gas channel 18 via the orifice 19 and the gas tube 6. This stream of gas wipes off into the bottle 32 filling material residue that might be adhering to the gas tube 6. In addition, this stream of gas also prevents ambient air from entering the mouth of the bottle 32. However, in the event that this stream of gas is not desired, a further control valve that controls the gas path 17 can be provided.

Modifications of the previously described method of operation are of course conceivable. For example, it would be possible to use an inert gas ($CO_2$) or an air-gas mixture having a high percentage of inert gas such as $CO_2$ as the compressed gas. Furthermore, it would also be possible to rinse the respective bottle 32 with the compressed gas that is being used prior to the pressurization, and in particular by opening the control valve 23, in which case the bottle 32 would be raised only to such an extent that the gas tube 6 extends into the interior of the bottle, but a gap remains between the mouth of the bottle 32 and the filling element 1.

Figure 2:
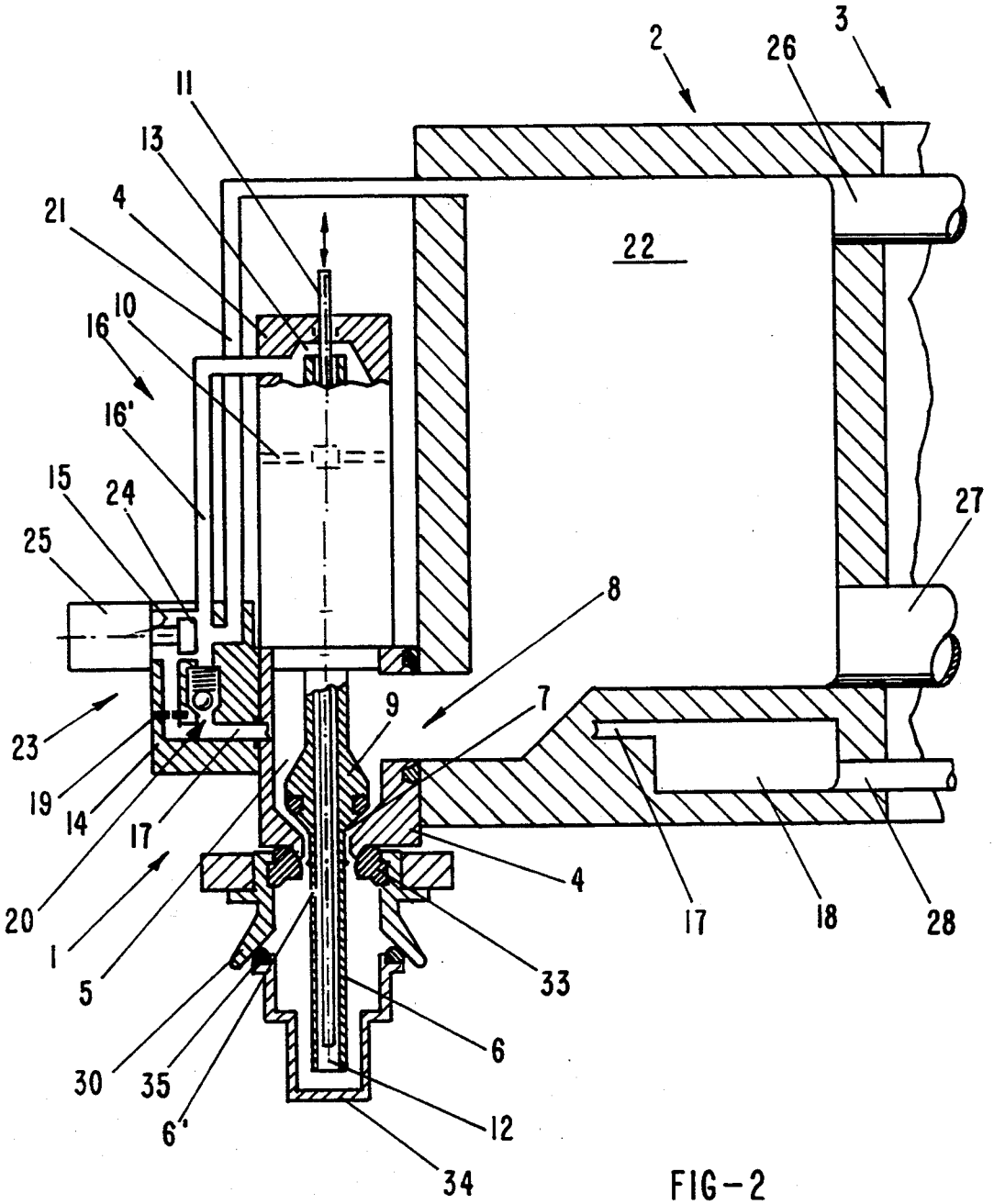
FIG. 2 is a view similar to that of FIG. 1, but with the filling element prepared for a CIP cleaning.

As indicated in FIG. 2, a cleaning in place, i.e. CIP cleaning, of the filling element 1 is also possible. For such a cleaning, a cap 34 is provided on the underside of the filling element 1. The cap 34 forms a rinsing chamber that accommodates the gas tube 6 and that is sealingly closed off to the outside by a sealing means 35 of the cap 34, by the centering tulip 30, and by the sealing means 33 thereof.

The cleaning medium used for the CIP cleaning is supplied to the residual gas channel 18 at an overpressure, for example at a pressure of 3.0 to 4.0 bar. Initially via the orifice 19, and then also via the check valve 20 that opens, the cleaning medium passes into the chamber 15 and from there flows through the gas path 16 and the gas channel 12. The cleaning fluid that exits the gas tube 6 into the cap 34 passes via the opened liquid flow valve 8 into the annular tank 2, which forms the return for the cleaning medium. The cleaning is effected in particular in that the cleaning medium first has a pressure that is not sufficient for opening the check valve 20, and in that this pressure then increases to the pressure that is necessary for opening the check valve. This ensures that initially the orifice 19 is adequately rinsed or cleaned. If the control valve 23 is also opened, the cleaning medium then also flows through the gas path 21.

As a modification of the embodiment that has been described, it is also possible for the residual gas channel 18 to communicate with the atmosphere via an opening or orifice, or for the gas path 17 to communicate directly with the atmosphere via. such an opening or orifice.

The present invention is, of course, in no way restricted to the specific disclosure of the specification and drawings, but also encompasses any modifications within the scope of the appended claims.

What is claimed is:

1. An apparatus for filling containers with a liquid filling material from a tank said apparatus comprising:

at least one filling element, each filling element having a liquid flow valve;

gas paths formed at least partially in said filling element and respectively connected to an interior of a container during a filling process, said gas paths including a first gas path that communicates with a chamber of said tank that contains pressurized gas at a first pressure, a second gas path for withdrawing said pressurized gas to a region having a second pressure that is less than said first pressure, and a third gas path that forms a common communication for said first and second gas paths to said interior of said container, said third gas path serving for supplying and also withdrawing said pressurized gas into and out of said container respectively, wherein said second gas path is in constant communication with said third gas path and hence with said interior of said container;

a control valve that is capable of an open position and a closed position, said control valve controlling communication of said first gas path with said third gas path and hence with said interior of said container;

a first actuating mechanism for said control valve;

a second actuating mechanism for said liquid flow valve;

at least one flow control means in said second gas path for determining an effective cross-sectional flow area thereof; and at least one check valve in said second gas path parallel to said at least one flow control means, said check valve opening in a direction of flow in said second gas path that establishes communication with at least one of said third and first gas paths.

2. An apparatus according to claim 1, wherein said control valve is provided in an easily accessible manner on an outer side of said filling element or a housing therefor.

3. An apparatus according to claim 1, wherein said first, second, and third gas paths open into a common chamber.

4. An apparatus according to claim 3, wherein a valve body of said control valve is disposed in said common chamber.

5. An apparatus according to claim 1, wherein said chamber of said tank with which said first gas path communicates is a gas chamber, and said tank is filled only partially with said liquid filling material.

6. An apparatus according to claim 1, wherein said second gas path is in communication with the atmosphere.

7. An apparatus according to claim 1, wherein said second gas path is in communication with a return gas or residual gas channel.

8. An apparatus according to claim 7, wherein means are provided for maintaining a prescribed value for said second pressure in said return gas or residual gas channel.

9. An apparatus according to claim 1, wherein means are provided for maintaining a prescribed value for said second pressure in said region.

10. An apparatus according to claim 1, wherein said filling element is provided with a gas tube, said third gas path including a gas channel that is formed in said gas tube.

11. An apparatus according to claim 10, wherein said gas channel of said gas tube surrounds a probe for determining filling height.

12. An apparatus according to claim 10, wherein above a lower end thereof, said gas tube is provided with an additional opening for said gas channel of said gas tube.

* * * * *